US011958654B1

(12) United States Patent
Vu

(10) Patent No.: US 11,958,654 B1
(45) Date of Patent: Apr. 16, 2024

(54) TIVI TRAY

(71) Applicant: Allison Marie Vu, Westminster, MD (US)

(72) Inventor: Allison Marie Vu, Westminster, MD (US)

( * ) Notice: Subject to any disclaimer, the term of this patent is extended or adjusted under 35 U.S.C. 154(b) by 0 days.

(21) Appl. No.: 18/117,460

(22) Filed: Mar. 5, 2023

(51) Int. Cl.
*B65D 1/36* (2006.01)
*A45C 11/36* (2006.01)

(52) U.S. Cl.
CPC ..... *B65D 1/36* (2013.01); *A45C 11/36* (2013.01)

(58) Field of Classification Search
CPC . A45C 11/36; B65D 1/36; B65D 1/34; B65D 81/3813; A47G 23/06; A47G 23/0608; A47G 23/0616; A47G 23/0625; A47G 23/0641; A47G 23/065
USPC ..... 206/561; D3/304, 313
See application file for complete search history.

(56) References Cited

U.S. PATENT DOCUMENTS

D146,697 S * 4/1947 Bates ..... D7/553.8
D183,822 S * 11/1958 Barnhart et al. ..... D7/553.8
3,491,894 A * 1/1970 Brown ..... B65D 1/36 211/74
D216,869 S * 3/1970 Britt ..... D7/553.5
D220,774 S * 5/1971 Goings ..... D7/553.4
3,905,506 A * 9/1975 Florian ..... B65D 1/36 229/406
D338,808 S * 8/1993 Anderson ..... D7/553.5
D349,425 S * 8/1994 Kays ..... D7/553.5
D396,953 S * 8/1998 Iversen ..... D3/310
D396,954 S * 8/1998 Iversen ..... D19/75
D444,302 S * 7/2001 Jones ..... D3/315
D472,711 S * 4/2003 Chen ..... D3/313
D591,560 S * 5/2009 Lackey ..... D7/550.1
D617,118 S * 6/2010 Fojtasek ..... D6/382
D617,119 S * 6/2010 Fojtasek ..... D6/683.1
D628,826 S * 12/2010 Kohler ..... D6/407
D634,541 S * 3/2011 Gutierrez ..... D3/313
D742,028 S * 10/2015 Hutchison ..... D24/227
D767,409 S * 9/2016 Nickell ..... D9/737
D786,621 S * 5/2017 Davis ..... D7/553.1
D848,795 S * 5/2019 Butler ..... D7/553.6
D890,951 S * 7/2020 Brennan ..... D24/227
D923,089 S * 6/2021 Zheng ..... D19/103
D954,451 S * 6/2022 Adkison ..... D6/300
D998,171 S * 9/2023 Chan ..... D24/226
2003/0006238 A1* 1/2003 Iacovelli ..... B65D 1/36 220/575
2017/0079451 A1* 3/2017 Wansink ..... B65B 5/068

FOREIGN PATENT DOCUMENTS

EP 3085278 * 10/2016 ..... A47D 1/0081

* cited by examiner

*Primary Examiner* — Joshua E Rodden

(57) ABSTRACT

Tivi Tray is a flexible activity tray made from food-grade silicone, featuring a main compartment that holds an A4 size piece of paper with 4 attached wells. This tool is dishwasher safe, BPA free, non-toxic and oven-safe, allowing it to keep the creativity flowing with all projects in the field of science, technology, engineering, art, and mathematics. It is an easy-to-clean, mess-contained surface for activities of all kinds—designed for children of all ages.

1 Claim, 1 Drawing Sheet

TIVI TRAY

BACKGROUND OF THE INVENTION

The present invention relates generally as a container for activities used to promote creativity in children of all ages and more specifically relates to a learning tool to be used in the fields of science, technology, engineering, arts, and mathematics.

Numerous activity surfaces, containers, and tools have been provided in prior art that are used as tools for projects in the fields of science, technology, engineering, art, and mathematics. These tools come in all shapes and sizes which include palettes, tubs, bins, etc., made from various materials such as wood, plastic, and metal.

The functionality of the tool is specific to the shape, size and material, making it specific choice for specific activities. A plastic paint palette is structured to hold multiple colors of a medium while an artist works on their project. A wood paint palette is used in the same way, however is not as easy to clean as its plastic counterpart. Tools that have the capability to be used for multiple projects have been used more frequently than those that are designed with a single utility. Additionally, tools intended for activities that create mess should be made from a material that is easily washable, while those that are designed to be used by children should be nonhazardous and nontoxic. Tools that feature the ability to be frozen, wet, heated, etc. have additional benefits regarding their utility across multiple projects. While the mentioned prior art may be used to act as a surface, tool, or container for activities, they may not be suitable for the purposes of the present invention as presently described.

BRIEF SUMMARY OF INVENTION

A primary objective of the present invention is to provide a surface that can be used for a variety of activities including, but not limited to, crafting, building, snacking, sorting, writing, cooking and sensory play.

Another primary objective of the present invention is to provide a surface that can be easily cleaned and sanitized.

An additional primary objective is to provide a surface that supports the use of multiple agents or mediums such as oil, water, paint, shaving cream, ice, etc. and can be frozen or heated.

A further primary objective is that the tray can be folded to take up minimal space when packing or storing.

Further objectives of the invention will appear as the description advances. To the accomplishment of the above and related objectives, the present invention may be represented in illustrated form through the accompanying drawings, attention being called to the fact, however, that the drawings are illustrative only.

DETAILED DESCRIPTION OF THE INVENTION

Figure 1:
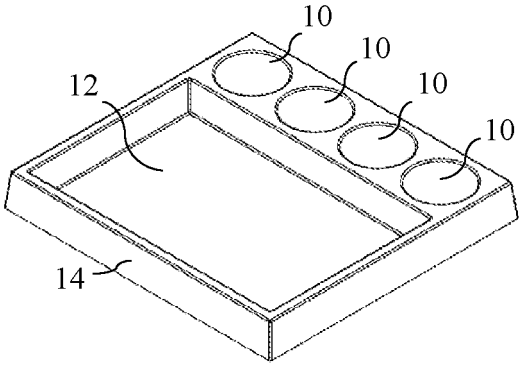
FIG. 1 is a top view of the invention.
Figure 2:
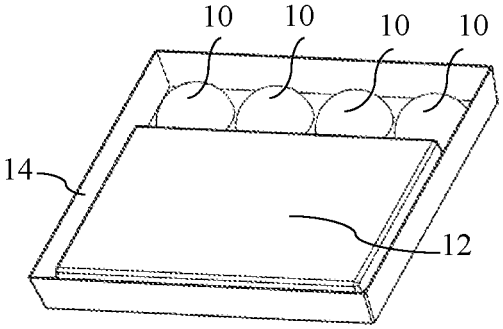
FIG. 2 is a bottom view of the invention.

The different figures depict various aspects of the invention. FIG. 1 depicts the top view of the Tivi Tray. It consists of an indented compartment tray 12, the tray 12 including a cavity (where 12 points in FIG. 1) including a bottom wall and a plurality of walls extending upwardly from the bottom wall, wherein the cavity terminates at a top wall, the cavity being located adjacent three out of four edges of the top wall, with the top wall extending adjacently to one side of the cavity and includes four equidistant and equal depth wells. The tray 12 including four surrounding side walls 14. The tray 12, the cavity, the surrounding side walls 14 and the four attached circle-shaped wells 10 are made from silicone. The silicone is food-grade, oven safe, dishwasher safe, BPA free and is non-toxic. Silicone is a soft material that is flexible enough to fold for easy storing and packing. Silicone can easily be washed with mild soap and water, and is freezer, dishwasher, and oven safe making it a top choice for a multifunctional activity tray. FIG. 2 is the bottom view of the Tivi Tray. The four circle-shaped wells 10 and bottom of the main tray 12 touch the surface on which the project uses as a foundation, such as a table, counter, floor, or any other surface on which it is placed, allowing it to be sturdy while in use.

The invention claimed is a silicone activity tray comprised of:

1. An activity tray comprising:

a cavity defined by a bottom wall and a plurality of walls extending upwardly from the bottom wall, wherein the cavity terminates at a top wall, the cavity being located adjacent three out of four edges of the top wall;

the top wall extends adjacently to one side of the cavity and includes four equidistant and equal depth wells;

four outside walls that extend down from respective ones of the four edges of the top wall;

wherein the depth of the wells, the four outside walls, and the cavity are generally aligned to touch a surface simultaneously; and wherein the tray is made from silicone is configured to be folded for easy storing and packing.

* * * * *